United States Patent [19]

Goldstein

[11] 4,095,395

[45] Jun. 20, 1978

[54] SELF-GUIDING STRETCH-WRAP MACHINE

[76] Inventor: Joseph Goldstein, 9838 Chicopee Ave., Northridge, Calif. 91325

[21] Appl. No.: 798,450

[22] Filed: May 19, 1977

Related U.S. Application Data

[63] Continuation-in-part of Ser. No. 752,444, Dec. 20, 1976.

[51] Int. Cl.[2] ..... B65B 13/10

[52] U.S. Cl. ..... 53/198 R; 53/184 R; 53/210

[58] Field of Search ..... 53/198 R, 139.3, 184 R, 53/196, 210, 218; 180/131, 79

[56] References Cited

U.S. PATENT DOCUMENTS

| | | | |
|---|---|---|---|
| 2,057,061 | 10/1936 | Eggerss | 53/139.3 |
| 2,563,542 | 8/1951 | Mackeldoff | 53/139.3 |
| 2,591,136 | 4/1952 | Cleary et al. | 53/139.3 |
| 3,003,297 | 10/1961 | Broadhead | 53/198 R |
| 3,393,762 | 7/1968 | Matson | 180/131 X |
| 3,910,005 | 10/1975 | Thimon et al. | 53/210 X |

*Primary Examiner*—Othell M. Simpson
*Assistant Examiner*—John Sipos
*Attorney, Agent, or Firm*—Allan M. Shapiro

[57] ABSTRACT

Motive unit carries stretch-wrap unit around stationary material unit to be wrapped. Motive unit is preferably self-propelled and is biased to be self-guided around the unit to be wrapped. Follower wheel contacts unit to be wrapped and controls steering. Propulsion urges motive unit toward material to be wrapped.

12 Claims, 4 Drawing Figures

16
28
22
14
42
32
26
10
44
30
46
43
34
48
38
62
65
12
68
60
56
40
20
70
50
54

SELF-GUIDING STRETCH-WRAP MACHINE

CROSS-REFERENCE

This is a continuation-in-part of patent application Ser. No. 752,444, Filed Dec. 20, 1976, entitled "Stretch-Wrap Machine" and an improvement thereon, the entire disclosure of which is incorporated herein by this reference.

BACKGROUND OF THE INVENTION

1. Field of the Invention

This invention is directed to a stretch-wrap machine wherein a motive unit carries a stretch-wrap unit around material to be wrapped, with the motive unit following the exterior of the material to be wrapped.

2. Description of the Prior Art

Modern mechanized handling requires that a number of small packages be packed together so that they can be handled in larger units. Pallets are used as a base, and packages are stacked on the pallet to a convenient size and weight for mechanical handling. One approach to retaining the packages on the pallet has been steel banding. Steel bands were placed around the packages and the pallet and the bands tightened and clamped. The problem with steel banding is that loads can shift, and under the wrong circumstances, all the packages on the outer extremities of the load directly under the steel bands can be crushed. Furthermore, the steel bands are difficult and dangerous to handle. Steel bands are most useful on heavy metal objects, such as pipe and other forms of steel. It must be noted that steel banding does not provide any weather protection for the packages.

A newer method of securing packages on a pallet to provide a palletized load is to shrink wrap the packages and the pallet. In this arrangement, bags are made out of shrink material (usually polyethylene), and the bag is placed over the palletized packages. Thereupon, the bag is subjected to heat whereupon it shrinks to unitize the palletized load. Shrink wrap is useful for loads which are of uniform size, but requires special equipment for causing the shrinkage. Since heat is used to cause the shrinkage, it cannot be used in cold rooms or other areas where high heat loads are objectionable. Furthermore, it cannot be used over polyethylene wrapped packages because of sticking between the shrink wrap material and such packages.

To overcome these disadvantages, stretchwrapping has been developed. In these machines, one of which is seen in Lancaster, U.S. Pat. No. 3,867,806 a stack of packages is placed on a turntable. Usually, these packages are mounted on a pallet. The turntable is rotated, and the palletized load of packages is wrapped with a stretch-wrap material. This material may be polyethylene or polyvinylchloride web or film and is manufactured to be able to stretch at least 25 percent. During wrapping of the load, tension on the stretch-wrap film provides a tension which stretches the film from 15 to 25 percent. The film is thin, usually about 1/100th of an inch, and the load is wrapped with as many thicknesses as is necessary to obtain the desired unitized load strength.

The stretch-wrap film may be as tall as the load or may be narrower than the height of the load. In the latter case, the narrower film is spiral-wrapped around the load. Since more wraps are necessary at the top and bottom of the load than at the middle for best strength, this is more economical of material. However, these stretch-wrap concepts have been limited to those loads which can be placed on the turntable and rotated.

The earlier invention referred to in the cross-reference above overcomes these disadvantages by having a motive unit which carries the stretch-wrap unit such that the motive unit is guided around material to be wrapped, and the material to be wrapped is in a stationary position. The guiding is through any of a variety of guiding or steering devices and methods. This invention further improves the stretch-wrapping process and apparatus.

SUMMARY OF THE INVENTION

In order to aid in the understanding of this invention, it can be stated in essentially summary form that it is directed to a stretch-wrap machine which comprises a motive unit carrying a stretch-wrap unit for tensioned release of stretch-wrap film so that, as the motive unit is moved around material in a stationary position which is to be stretch-wrapped, wrapping is accomplished. Guidance of the motive unit is accomplished by following around the material by direct contact therewith or with its support.

It is thus an object of this invention to provide a self-guiding stretch-wrap machine which is capable of moving around material to be wrapped so that the stretch-wrap on the motive unit can be released with controlled tension to wrap stationary material loads. It is a further object to provide a stretch-wrap machine wherein the stretch wrap unit is moved around the structure of material to be packaged with the wrap while the material to be wrapped stands stationary. It is a further object to provide a stretch-wrap motive unit which is guided around the structure of material to be wrapped by contact with the structure or with its support.

It is a further object to provide a stretch-wrap machine wherein the motive unit has a follower which contacts the material to be wrapped or with its support so that the motive unit is guided in its circuit around the material by steering sensing contact therewith. It is another object of this invention to provide a motive unit in a stretch-wrap machine wherein the propulsion of the motive unit is biased so that the motive unit is propelled in a direction which tends to propel it in a path around the material to be wrapped. It is a further object of this invention to provide a stretch-wrap machine which is economic of use and is capable of wide utility in the kinds of loads it can wrap without the need for permanent or expensive installations devoted to the purpose.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

DESCRIPTION OF THE PREFERRED EMBODIMENT

Figure 1:
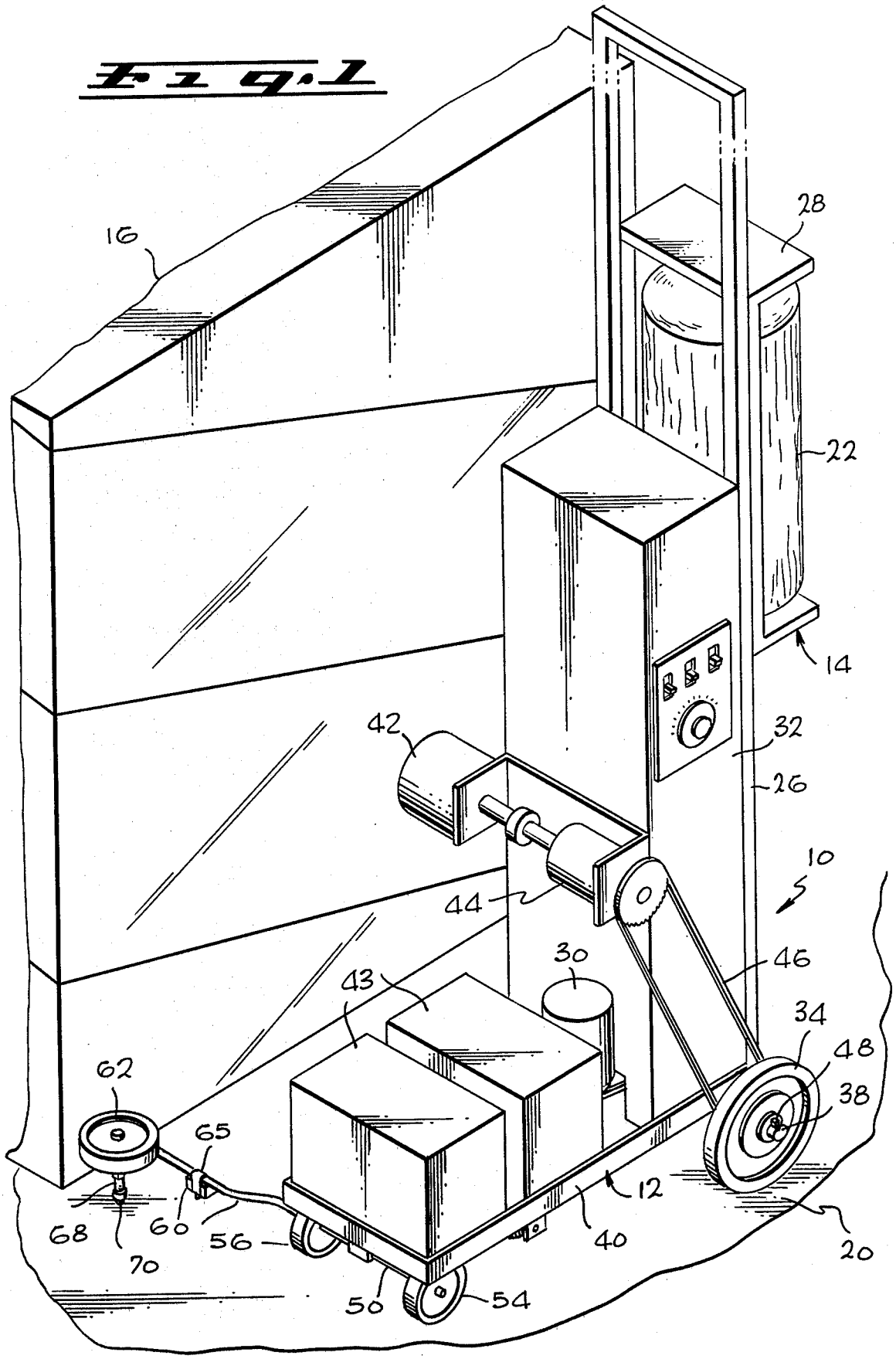
FIG. 1 is a perspective view of a preferred embodiment of the stretch-wrap machine of this invention.
Figure 2:
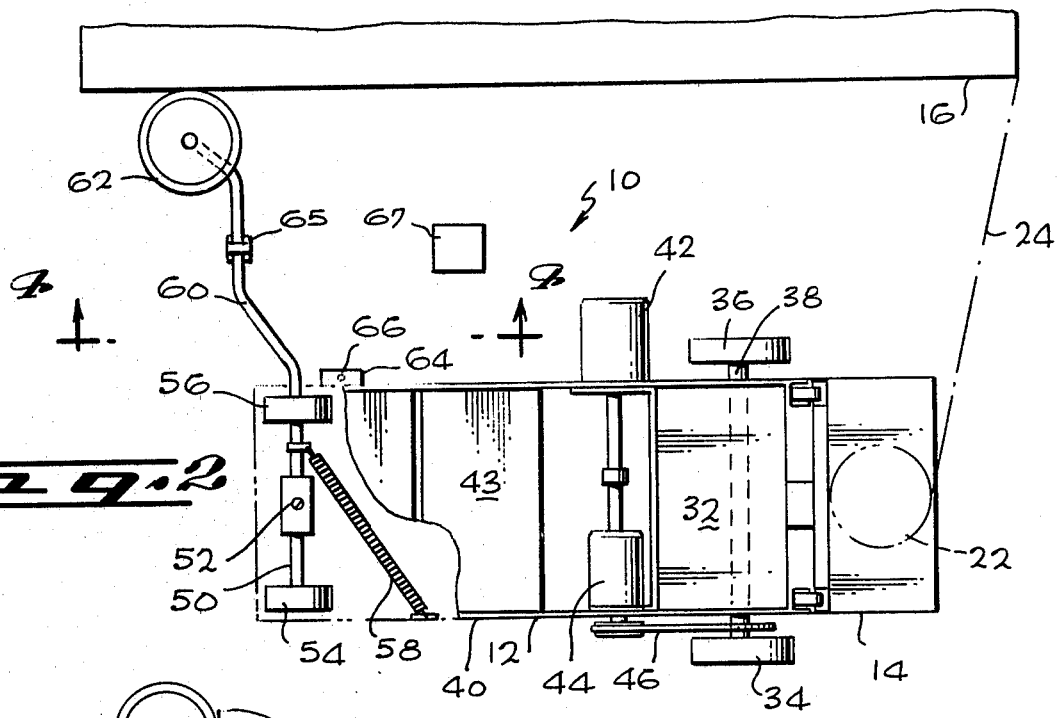
FIG. 2 is a top plan view of the stretch-wrap machine of FIG. 1 with parts broken away to show the steering mechanism.
Figure 3:
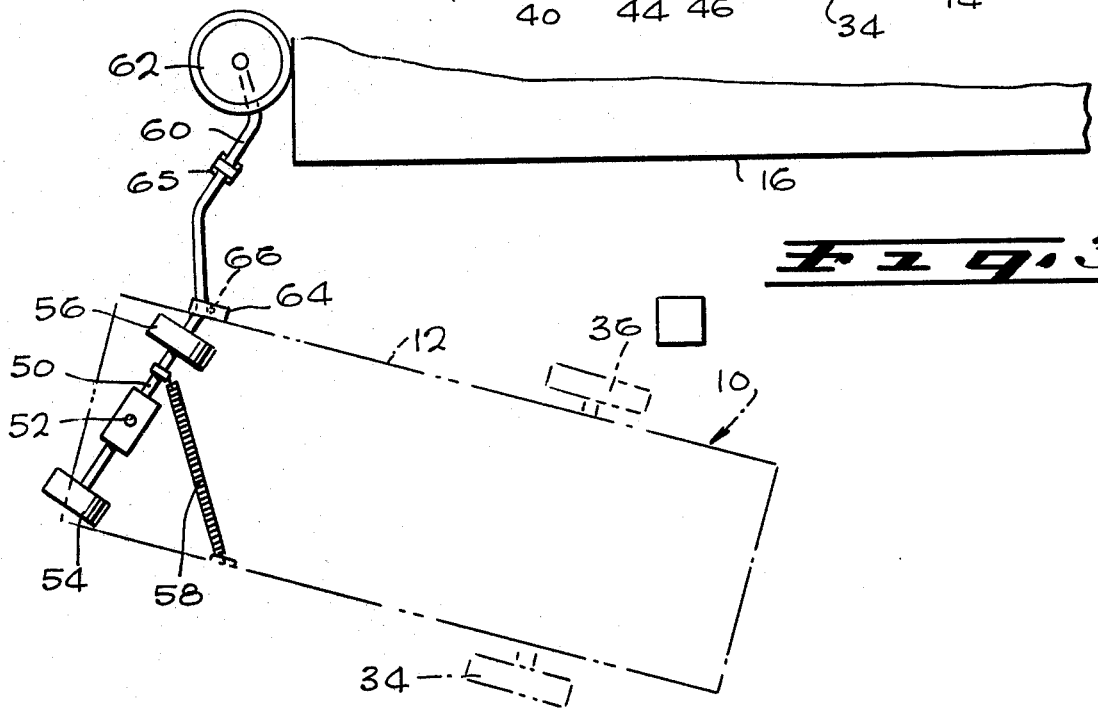
FIG. 3 is a top plan view similar to FIG. 2, but showing the stretch-wrap machine starting around a corner of the material to be wrapped, by means of its self-guidance.

Stretch-wrap machine 10 is shown in FIGS. 1, 2 and 3. The stretch-wrap machine 10 comprises motive unit or vehicle 12 and stretch-unit 14. The stretch-wrap unit is mounted on the motive unit, and the purpose of the motive unit is to move the stretch-wrap unit around the material to be wrapped. In FIGS. 1 through 4, the material to be wrapped is indicated at 16 and, in FIG. 4, it is illustrated as being positioned on pallet 18. The material 16 to be wrapped can be a wide variety of different types, from one large carton which needs strengthening, water-proofing, or securement to its pallet, or may be a stack of smaller cartons or bags which need to be held together and/or also held onto a pallet to make the load stable. On the other hand, the material to be wrapped may not be packaged, but may be furniture or the like which needs to be wrapped to protect it in storage or shipping. The material to be wrapped is placed on the floor 20, see FIGS. 1 and 4, and is positioned away from walls, posts, or other equipment sufficiently far that the stretch-wrap machine 10 can move around it.

Stretch-wrap unit 14 is illustrated as carrying roll 22 of stretch-wrap film 24. The stretch-wrap unit releases film 24 with appropriate tension as the motive unit carries the stretch-wrap unit around the material to be wrapped. When the width of film 24 in the height direction is sufficient to properly wrap the material to be wrapped, then no spiral traverse of the stretch-wrap roll is required. However, for illustrative purposes, rails 26 carry carriage 28 upon which roll 22 is mounted for tensioned release. Motor 30 moves the carriage along its rails as the motive unit moves so that spiral wrapping is achieved, as indicated in FIG. 1. In this way, wrapping of a tall load of material to be wrapped is accomplished. Control cabinet 32 houses the controls for the various motors and control of the tension, if such is required. This stretch-wrap unit is thus of the same nature as the stretch-wrap unit described with respect to the earlier invention.

Motive unit or vehicle 12 is supported by four wheels for free movement along floor 20. The rear wheels 34 and 36 are mounted on axle 38, which is mounted on bearings on the bottom of platform 40 of the motive unit. Motor 42, sees FIGS. 1 and 2, is connected through reduction gear 44 and belt or chain 46 to drive axle 38. Motor 42 is controlled by appropriate controls in control cabinet 34. The switches and knobs on the cabinet can control the on-off function of the motor and the speed at which it propels the motive unit along the floor.

Batteries may be provided in housings 43 to supply power to the propulsion motor, the stretch-wrap carriage motor, and the control system so that the stretch-wrap machine is self-powered and is completely independent of any external power supply.

Only left rear wheel 34 is keyed to axle 38, as by key 48. Wheel 36 is freely rotatable on the axle so that the propulsion of the motive unit tends to urge the motive unit in a clockwise circle when the motive unit moves to the left, as seen in FIG. 2. Other motive means can accomplish this result. For example, the right rear wheel can be a caster, while belt 46 directly engages a pulley on the inside of wheel 34, which would be freely rotatable on a stub shaft. On the other hand, both rear wheels could be driven but with much higher propulsion force on the left rear wheel 34 than on the right rear wheel 36 by the use of a special, unbalanced differential. Such a differential could place any desired fraction of the propulsion force on the left rear wheel, but the right rear wheel could also contribute toward motivation to optimize stretch-wrap tensioning.

Front axle 50 is pivoted on vertical steering pivot pin 52 on the bottom of platform 40 adjacent the front end thereof. Front wheels 54 and 56 are freely rotatably mounted on the front axle. Spring 58 is connected to the axle to bias the axle to urge it to steer the motive unit to make clockwise circles, as shown in FIG. 3. Thus, steering is biased in the same direction as is the propulsion of the motive unit, i.e., toward material 16. In the preferred embodiment thus described, both the propulsion and steering are biased for turning the motive unit in that direction. In optimum circumstances, the biasing of only one of these turning forces may be satisfactory. In any event, it is apparent that the propulsion motor drives the vehicle or motive unit along the floor, and the propulsion and/or the steering continually biases the vehicle to move in a direction toward the material to be wrapped, without external guidance.

Feeler arm 60 projects in a direction toward the material to be wrapped and carries follower roller 62 on the front end thereof. The arm projects from a side of the vehicle and is configured so that follower roller 62 is positioned to follow along the side of the material 16 to be wrapped or along a side of a support for material 16 (both such sides being referred to as surfaces associated with the material 16), thereby counteracting the clockwise turning moment provided both by the propulsion unit and the bias steering. Roller 62 engages the side of the material 16 in response to the biasing of the motive unit toward the material and provides a counteractive force which limits the movement of the motive unit toward material 16 and causes the motive unit to follow along the side of the material 16 without further turning toward it. Any further turning toward it would cause the follower roller 62 to turn the steering wheels out so that the motive unit is self-guided from the material 16. The straight-ahead direction along the straight edge of the material 16 is shown in FIGS. 1 and 2. FIG. 3 shows that, when follower roller 16 reaches the corner, the bias of the steering and the bias of the propulsion causes the motive unit to immediately turn around the corner. In this way, the motive unit carries the stretch-wrap unit around and around the material 16 to be wrapped. As the motive unit is driven along the floor around the material to be wrapped, either by the propulsion alone or in conjunction with the steering, it is clear that the stretch-wrap film wraps the material for its secure packaging and protection.

Switch 64 is positioned on the underside of platform 40 and has dog 66 extending from the bottom thereof. This dog is contacted by feeler arm 60 each time the feeler arm and the steering turn far enough for the stretch-wrap machine to go around a corner, as shown in FIG. 3. Switch 64 is connected into control cabinet 32 wherein the corners are counted. When the desired number of corners has been negotiated so that stretch-wrapping is complete, the machine can thus shut itself off. In this way, stopping can be automatically accomplished.

In some cases, the material to be wrapped does not have corners or is oddly configured so that the corner-counting switch 64 is not applicable. Accordingly, arm 60 is provided with a sensor or switch 65 depending therefrom and adapted to make contact with a switch actuator block 67. Thus, block 67 is disposed between the path of the motive unit and the material to be wrapped so that arm 60 passes over block 67 once per wrapping revolution or turn. Switch 65 which is actuated by such passing contact, is connected into control cabinet 32 wherein the revolutions or turns are counted so that the machine can shut itself off when the stretch-wrapping is completed. It should be noted that the location of switch 65 on arm 60 is for ease and convenience, since sensor or switch 65 also may be locatable on an auxiliary arm mounted on the motive unit and directed to port or starboard with respect to the motive unit so as to pass over the appropriately located actuator block 67. Also, other conventional sensing means, including optical and electromagnetic, for example, can be used instead of switches 64 or 65, with corresponding changes in the actuators therefor.

Figure 4:
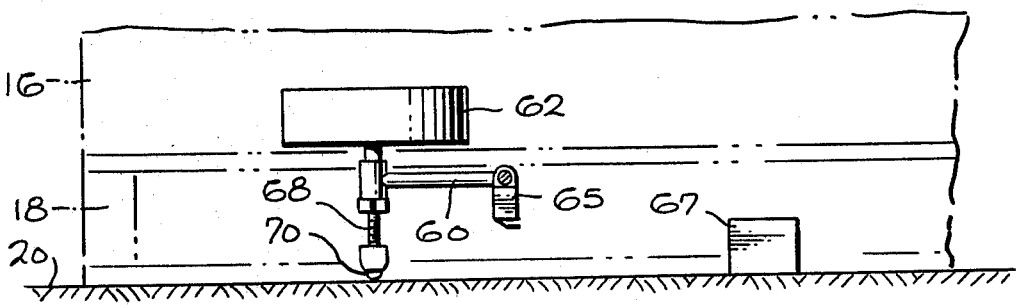
FIG. 4 is an enlarged elevational view, with parts broken away, taken generally along the line 4—4 of FIG. 2.

In view of the fact that different materials to be wrapped may have different characteristics adjacent their lower edge for the follower roller to follow, the follower roller 62 can be provided with vertical adjustment. As is seen in FIG. 4, adjustable leg 68 has floor-following roller 70 on the bottom thereof. By adjusting the height of leg 68, the height of follower roller 62 above the floor is adjusted. When the load is palletized, of course, follower roller 62 must be above the pallet openings. Another way of accomplishing the desired result is to have a fairly tall follower roller 62 supported by a floor roller so that the follower roller engages the highest point, whether the pallet or the pallet load.

This invention having been described in its preferred embodiment, it is clear that is is susceptible to numerous modifications and embodiments within the ability of those skilled in the art and without the exercise of the inventive faculty. Accordingly, the scope of this invention is defined by the scope of the following claims.

What is claimed is:

1. A stretch-wrap machine comprising:

a vehicle including, as components of the vehicle, means for supporting the vehicle for free movement along a floor, means for driving the vehicle along the floor around material to be wrapped, said driving means including means for continually biasing the vehicle to move in a direction toward said material without external guidance, and feeler means projecting in said direction for engaging a surface associated with said material in response to said biasing and thereby limiting the movement of the vehicle toward said material; and a stretch-wrap unit mounted on the vehicle for movement therewith along the floor and including means for wrapping stretch-wrap film around the material to be wrapped as the vehicle travels on the floor around said material.

2. The stretch-wrap machine of claim 1, wherein said feeler means projects from one side of the vehicle and said means for supporting the vehicle comprises a propulsion wheel on the opposite side of the vehicle, and wherein said driving means, including said biasing means, comprises means for propelling said wheel.

3. The stretch-wrap machine of claim 2, wherein said means for supporting the vehicle also comprises an additional wheel at said one side of the vehicle.

4. The stretch-wrap machine of claim 1, wherein said means for supporting the vehicle comprises at least one propulsion wheel and at least one steerable wheel, and wherein said means for driving the vehicle comprises means for propelling said propulsion wheel, said biasing means comprising means for urging said steerable wheel to steer toward the material to be wrapped.

5. The stretch-wrap machine of claim 4, further comprising means connecting said feeler means to said steerable wheel for steering said steerable wheel in accordance with the shape of said surface engaged by said feeler means.

6. The stretch-wrap machine of claim 4, wherein said biasing means comprises a spring connected to said steerable wheel.

7. The stretch-wrap machine of claim 1, wherein said feeler means has a roller for engaging said surface.

8. The stretch-wrap machine of claim 7, wherein said roller is of adjustable height to adjust the level at which the roller engages said surface.

9. The stretch-wrap machine of claim 1, further comprising means for counting the number of revolutions of said vehicle about the material to be wrapped.

10. The stretch-wrap machine of claim 9, wherein said counting means comprises means for counting the number of corners of the material to be wrapped that are passed by the vehicle.

11. The stretch-wrap machine of claim 10, wherein said means for supporting the vehicle comprises a steerable wheel, wherein said biasing means comprises means for urging said wheel to steer in a direction toward the material to be wrapped, and wherein said counting means comprises means responsive to the steering of said wheel as the vehicle passes a corner of the material to be wrapped.

12. The stretch-wrap machine of claim 9, wherein said counting means comprises a sensor mounted on said vehicle and a sensor actuator fixed relative to the material to be wrapped and positioned to actuate the sensor each time the vehicle has completed a revolution about the material to be wrapped.

* * * * *